US005195214A

United States Patent [19]

Lautenschläger et al.

[11] Patent Number: 5,195,214

[45] Date of Patent: Mar. 23, 1993

[54] HINGE HOUSING

[75] Inventors: Horst Lautenschläger; Reinhard Lautenschläger, both of Reinheim, Fed. Rep. of Germany

[73] Assignee: Karl Lautenschlager GmbH & Co. KG, Reinheim, Fed. Rep. of Germany

[21] Appl. No.: 749,969

[22] Filed: Aug. 26, 1991

[30] Foreign Application Priority Data

Nov. 28, 1990 [DE] Fed. Rep. of Germany ..... 4037752

[51] Int. Cl.[5] ..... E05D 5/00

[52] U.S. Cl. ..... 16/382; 16/DIG. 43

[58] Field of Search ..... 16/272, 257, 251, DIG. 43, 16/382

[56] References Cited

U.S. PATENT DOCUMENTS 4,270,240 6/1981 Zernig et al. ..... 16/382
4,376,324 3/1983 Lautenschlager et al. ..... 16/382

FOREIGN PATENT DOCUMENTS 2606181 12/1983 Fed. Rep. of Germany .
2636767 7/1987 Fed. Rep. of Germany .
3722950 1/1989 Fed. Rep. of Germany ..... 16/382
1381965 1/1975 United Kingdom ..... 16/382

*Primary Examiner*—Robert L. Spruill
*Assistant Examiner*—Carmine Cuda

[57] ABSTRACT

The invention relates to a hinge housing in the form of a cup which can be sunk in a mortise in the back of the door of a piece of furniture and which has a cup portion made of metal from whose upper margin a mounting flange projects integrally in the position properly mounted on a door and overlaps areas of the inside of the door adjoining the mortise in the door, and whose margin is curved toward the inside of the door, so that in the mounting flange there is formed a shallow recess open on the inside of the door, and having a socket plate of plastic disposed between the mounting flange and the inside of the door, which can be releasably joined to the mounting flange and the door.

19 Claims, 5 Drawing Sheets

Fig. 5
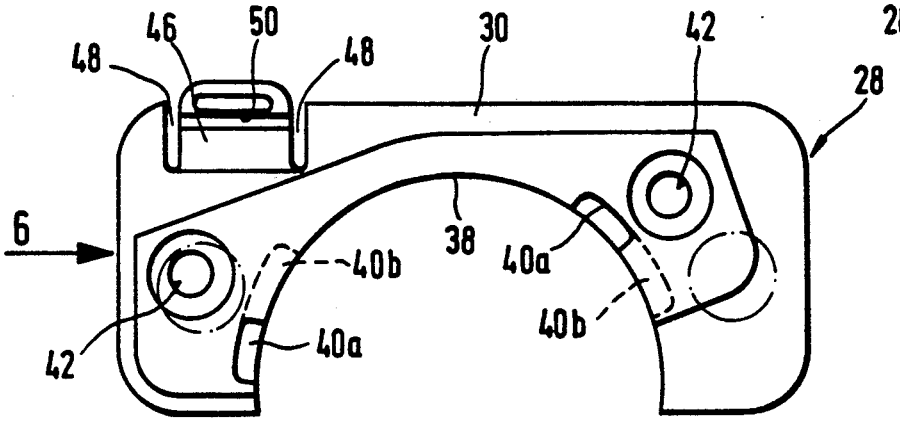
Fig. 6
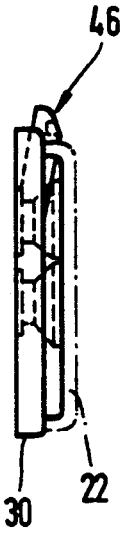
Fig. 7
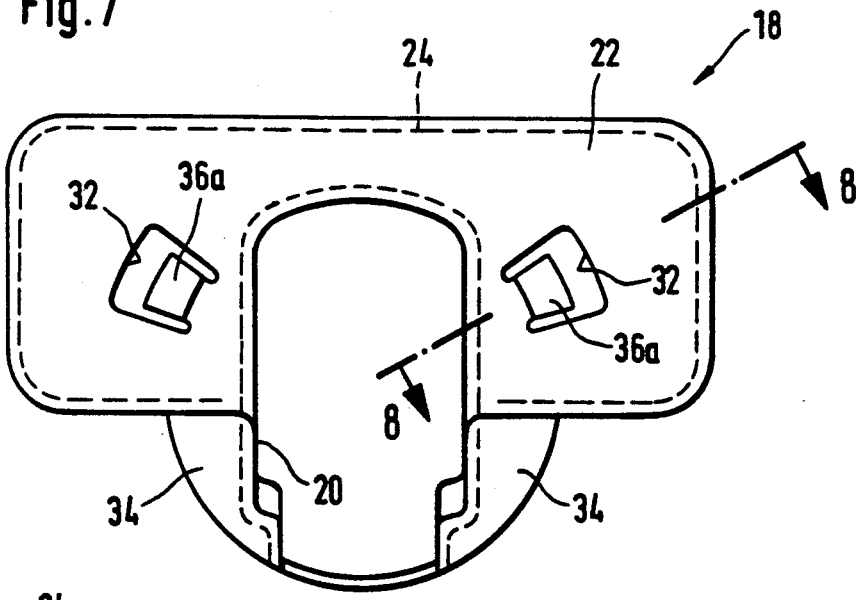
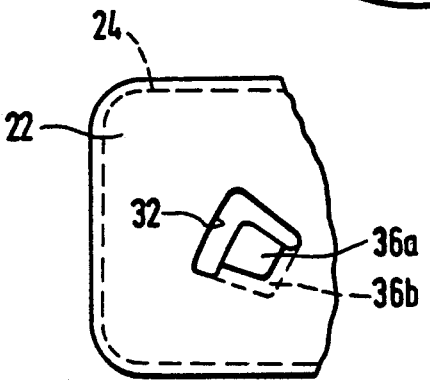
Fig. 9
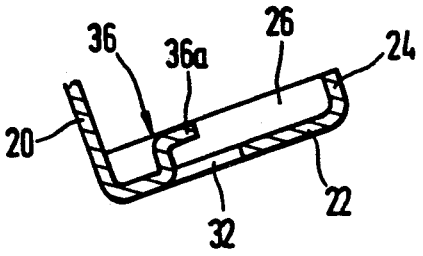
Fig. 8

HINGE HOUSING

BACKGROUND OF THE INVENTION

The invention relates to a hinge housing in the form of a cup which can be sunk in a mortise in the back of the door of a piece of furniture and which has a cup portion made of metal from whose upper margin a mounting flange projects integrally in the position properly mounted on a door and overlaps areas of the inside of the door adjoining the mortise in the door, and whose margin is curved toward the inside of the door, so that in the mounting flange there is formed a shallow recess open on the inside of the door, and having a socket plate of plastic disposed between the mounting flange and the inside of the door, which can be releasably joined to the mounting flange and the door.

In comparison to the plastic hinge housings predominantly used formerly, it has in recent years become increasingly popular to configure in this manner hinge housings which serve as door-mounted hinge parts and can be fastened in a mortise in the inside of the door of a cabinet in modern multi-joint cabinet hinges, i.e., to configure them in the form of a hinge housing composed of a cup part made of metal with a mounting flange and a socket of plastic which is virtually invisible after being fastened to or in the door. The metal part, made from sheet metal by stamping and pressing or by pressure casting methods from a metal alloy, thus on the one hand determines the appearance of the hinge housing, and on the other hand assures the necessary great strength, while the plastic socket, which in the installed state is invisible or nearly invisible, assures the precise alignment of the metal part in the mortise in the door. The hinge housing is fastened to the door with one or two screws passing through countersunk bores in the mounting flange of the metal part and openings in the part of the plastic socket that is under them, and they are either driven directly into the door or engage in mounting posts provided on the socket, which in turn are held in mounting holes bored into the door at a distance from the mortise for the cup part. These mounting posts, preferably made integral with the socket by injection molding, are oversized with respect to the inside diameter of the mounting bores in the door, so that they tightly join the mounted hinge housing to the door. By configuring the mounting posts in the manner of expansion plugs, which can be spread open by the mounting screws, the tight seating of the hinge housing on or in the door can be further improved. Removal of the hinge housing from the door, however, is possible by removing the mounting screws, since then the attachment of the metal part to the socket is unfastened. This screwing involves work, and if the metal part with the socket is repeatedly removed and reattached the threads of the mounting screws in the mounting posts, or, if the latter are omitted, in the walls of the mounting bores in the door, become worn out, so that the firm seating and secure mounting of the hinge housing on the door suffers. See the hammer-in housing disclosed in German Patents 26 06 181 and 26 36 767, for an example of the known hinge housing.

It is the aim of the invention, on the other hand, to improve the known hinge housings such that they can be installed on an associated door more easily and quickly without a tool, and will be removable again, if necessary, without injury to the integrity of the fit even when repeatedly installed and removed.

The Invention

Setting out from a hinge housing of the kind referred to above, this aim is achieved in accordance with the invention by providing a locking device which releasably joins the socket plate and the mounting flange of the cup part in the manner of a bayonet lock through the rotation of the cup part through a given angle relative to the socket plate about an axis of rotation at right angles to the inside of the door.

In a preferred further development of the invention the configuration is made such that the mounting flange has on its bottom facing the door at least two locking projections, running radially at least in sections and provided at a distance apart from one another and at a distance away from the mounting plate's bottom with respect to the longitudinal central axis of the door mortise provided for the accommodation of the cup part, and that with each locking projection there is associated a locking groove undercut substantially in a plane parallel to the inside of the door for receiving the particular locking projection, the locking grooves each having at one end a section open toward the top on the mounting flange side for the entry of the associated locking projection. It is thus possible simply and quickly to lock the cup part made of metal to the socket plate previously mounted on the door, this locking action being performed in a manner comparable to a bayonet lock, by first introducing the cup part, initially rotated relative to the socket plate, into the mortise, the locking projections entering into the entry portion of the locking groove. Then, as soon as the cup part has been inserted until the mounting flange is lying against the socket plate, it is rotated to the proper installed position, while the locking projections enter into the actual locking groove and then secure the cup part against escape from the mortise in the door. By creating a slight ramp in the course of the locking groove, it is also possible to assure that the mounting flange of the metal cup part will additionally be drawn into firm contact with the socket plate and thus with the inside of the door when the locking is performed.

If the cup part has been made by stamping from sheet metal, the locking projections can advantageously be lugs cut along three sides from the material of the mounting flange and bent first at right angles to the inside of the door, then bending their free end sections back in a direction substantially parallel to the mounting flange and pointing radially outwardly. In the mounting flanges material sections are then formed which correspond to those which are cut free for the formation of the locking projections. By appropriate coloring of the plastic material of the socket plate it can be arranged so that these openings in the mounting flange will not be conspicuous. On the other hand, by deliberately using a different color the openings can be left visible in an attractive manner. If the cup part together with the mounting flange is made by pressure casting from a metal alloy, such as the zinc die casting alloy (Zamak) often used for furniture hardware, the locking projections can project radially from the free ends of connecting projections integrally cast on the bottom of the mounting flange. By appropriately designing the casting die, cup parts having no openings in the mounting flange can be manufactured, although such openings can be provided in this case as well. The associated casting dies are then simplified by the fact that, instead of the otherwise necessary sliders for the formation of the locking projections, solid projections are formed on the upper half of the die, which create the openings in the mounting flanges.

The locking projections can additionally be stabilized by means of a section of material joining their lateral edges facing away from the locking direction to the mounting flange.

Alternatively, the configuration can also be made such that the locking projections project from the free edge of the bent margin toward the cup part and into the recess in the mounting flange.

The area of the socket plate facing the cup part is arcuately defined, at least section-wise and the center of the radii of its arcuate boundary coincides with the central axis of the cup mortise in the door when the cup is fastened in the door. The radius of the arcuate boundary is then preferably selected such that it corresponds substantially to the radius of the mortise in the door.

The locking grooves can then be arranged such that they open into the arcuate boundary of the socket plate.

If the locking projections are set on the free edges of the bent margin of the mounting flange, the configuration of the socket plate is made such that the locking grooves run into the outer circumferential defining area of the socket plate associated with the margin of the mounting flange.

The socket plate made of plastic can be manufactured with a thickness exceeding the depth of the recess formed in the mounting flange, in which case the lower part of the socket plate facing the door and protruding from the recess is shaped to correspond to the external outline of the mounting flange. When the hinge is installed, a thin layer of the socket plate is visible between the free edge of the mounting flange of the cup part and the inside of the door.

The upper part of the socket plate situated within the recess in the mounting flange is then shaped so that it fills the recess only in part of its area, and when the socket plate and mounting flange are properly locked in place, the cavities, which not formed by material of the upper part of the socket plate, are defined so that the mounting flange can be placed on the socket plate in a position turned at an angle about the central axis of an associated door mortise and can be rotated to the proper locking position, and the allowable turning angle is so chosen that the locking projections of the mounting flange can be brought into alignment flush with the open upper side of the associated entry section of the locking grooves.

In contrast to the above examples, the locking mechanism between the mounting flange and the socket plate can also be designed such that the mounting flange has at least two locking holes spaced apart from one another, each with an arcuately running, slot-like locking section and each having an enlarged entry section provided at one end of the locking section, and that from the upper side of the socket plate facing the mounting flange a locking projection projects, which is formed by a shaft protruding from the socket plate and a locking head of increased diameter provided on its free end, and whose shaft diameter is slightly smaller than the width of the locking section and of the locking head and greater than the width of the locking section, yet smaller or, in any case, equal to the diameter of the entry section of the locking hole.

It is then advantageous if the locking holes are formed in each case in areas of the mounting flange which have been formed inwardly into the depth. The height of the locking heads is then best made equal to the depth of the deepened mounting flange section. The locking heads then do not project above the top of the mounting flange when in the proper locking position.

In order additionally to secure the metal cup part in the proper fastening position on the door, a configuration is recommendable wherein the socket plate has at least one tongue projecting partially outward beyond the margin of the mounting flange and movable at right angles to the inside of the door, which, in the area lying opposite the free edge of the bent margin of the mounting flange in the proper locking position, has a groove-like recess that fits the margin, the tongue being resiliently biased toward a position wherein it is lifted away from the inside of the door and receives the associated marginal area of the mounting flange. The cup part can be removed from the door only when first the cup part is unlocked by pressure on the outwardly projecting section of the tongue such that the margin of the mounting flange comes free of the groove-like recess of the tongue.

The tongue can be configured as an integral part of the socket plate, by being separated from the laterally adjoining areas of the actual socket plate by two through-going lateral mounting slots, and being joined integrally to the socket plate at its inner end on the mounting flange side.

A section of the tongue is best chamfered on the top such that the margin of the mounting flange riding against the tongue when the metal cup part is rotated relative to the socket plate from the angled to the locking position forces the tongue increasingly toward the inside of the door against its bias until the groove-like recess is aligned with the bent margin. When the metal cup part is installed on a door, the chamfer serving as a ramp on the upper part will automatically cause the tongue to be forced back by the margin of the mounting flange when it is turned angularly for the purpose of locking the cup part, until it is able, in the proper mounting position, to snap back into locking engagement of its groove-like recess with the margin of the mounting flange.

BRIEF DESCRIPTION OF THE DRAWINGS

The invention will be further explained in the description that follows of an example of its embodiment, in conjunction with the drawing, wherein:

FIG. 5 is a top view of the socket plate, seen in the direction of arrow 5 in FIG. 4, FIG. 6 is a side view of the socket plate, seen in the direction of arrow 6 in FIG. 5, FIG. 7 is a top view of the metal cup part, seen in the direction of the arrow 7 in FIG. 3, FIG. 8 is a section through part of the cup seen in the direction of the arrows 8—8 in FIG. 7, FIG. 9 is a top of the section seen on the left in FIG. 7 of the mounting flange with a variant configuration in the area of the locking projection.

DETAILED DESCRIPTION OF PREFERRED EMBODIMENTS

Figure 1:
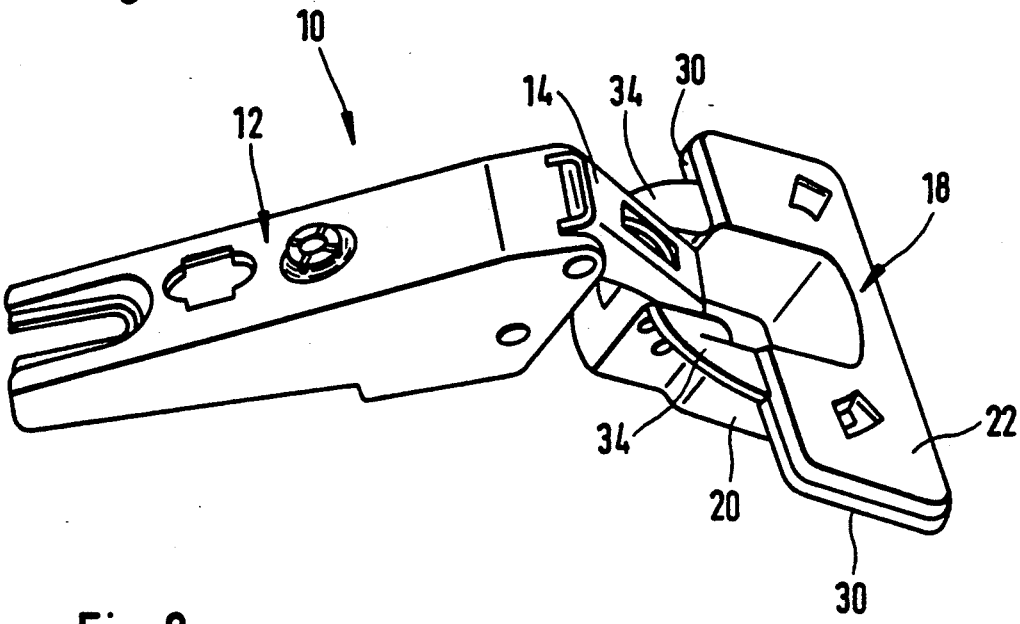
FIG. 1 is a perspective view of a cabinet hinge designed as a four-joint hinge in the open state, with a hinge housing constructed in the manner of the invention.
Figure 2:
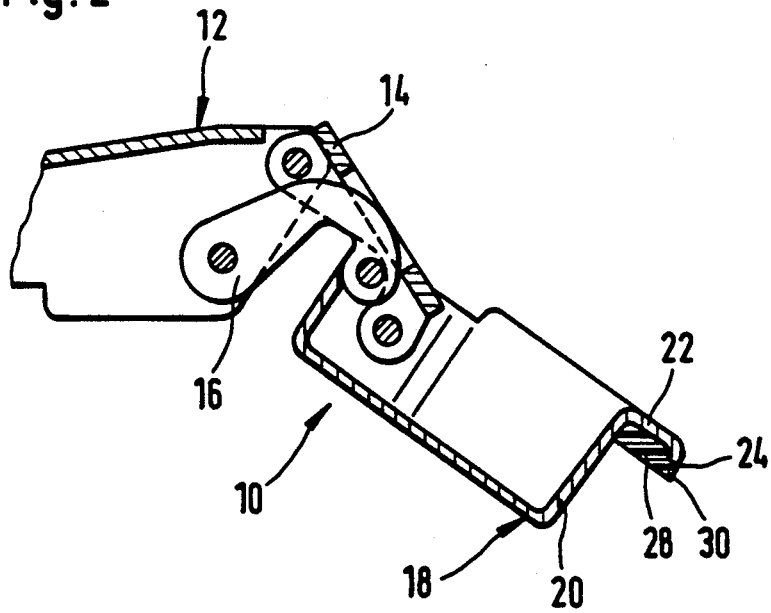
FIG. 2 is a longitudinal central section through the hinge housing, the hinge links forming the joint, and the front end of the supporting arm of the hinge shown in FIG. 1.

The hinge shown in FIGS. 1 and 2 and identified as a whole by the number 10 is a four-joint hinge whose supporting-wall-related hinge part, designed as a supporting arm 12, and adjustably mounted in a conventional manner on a mounting plate (not shown) fastened to a cabinet side wall, is pivotingly coupled by two hinge links 14 and 16 to a hinge housing in accordance with the invention, which will be further explained below in connection with FIGS. 3 to 8. The hinge housing is in the known form of a cup which can be sunk in a mortise in the back of a cabinet door, and has a cup part 20 made of metal, from whose upper margin a mounting flange projects integrally which, in the properly mounted position on the door, overlaps areas on its inner side adjoining the mortise in the door. In the depicted case the actual cup part 20 and the mounting flange 22 formed integrally therewith are made by stamping from sheet metal, although they could also be made by the pressure casting process from a suitable metal alloy, such as one of the zinc pressure casting alloys (Zamak) widely used for furniture hardware.

The outer circumferential margin 24 of the mounting flange 22 is bent around toward the inner side of the door, thus forming a shallow recess 26 in the bottom of the mounting flange, in which a socket plate 28 of plastic is disposed, whose thickness is slightly greater than the depth of the recess 26, so that, in a hinge housing 18 fastened to a door, a circumferential marginal strip 30 of the socket plate 28 is visible between the edge 24 of the mounting flange 22 and the inside of the door. On opposite sides of the plane of symmetry of the hinge housing 18, two openings 32 are provided in the upper side of the mounting flange, which will be further described below in conjunction with FIGS. 3, 7 and 8.

Figure 4:
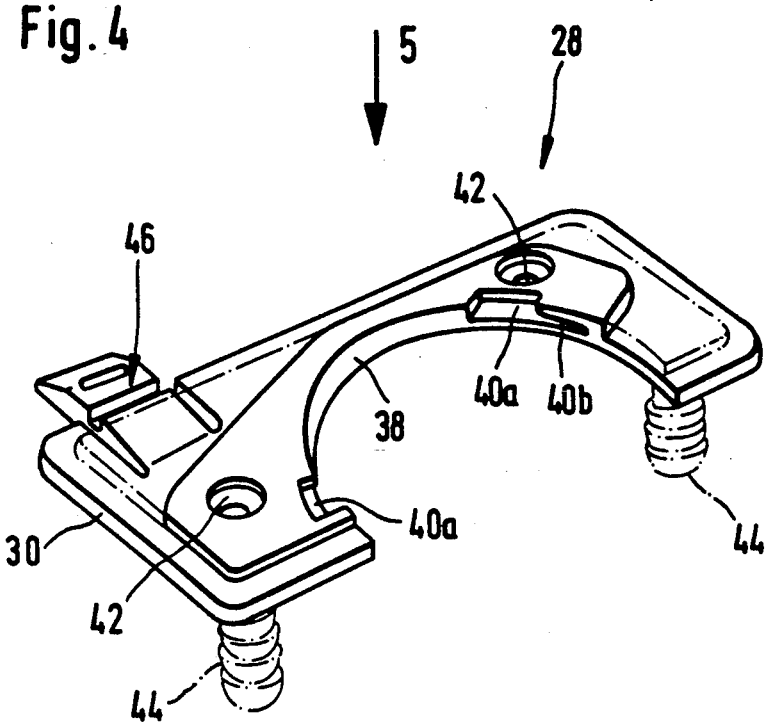
FIG. 4 is a perspective view of the socket plate of the housing of the hinge shown in FIGS. 1 and 2.
Figure 3:
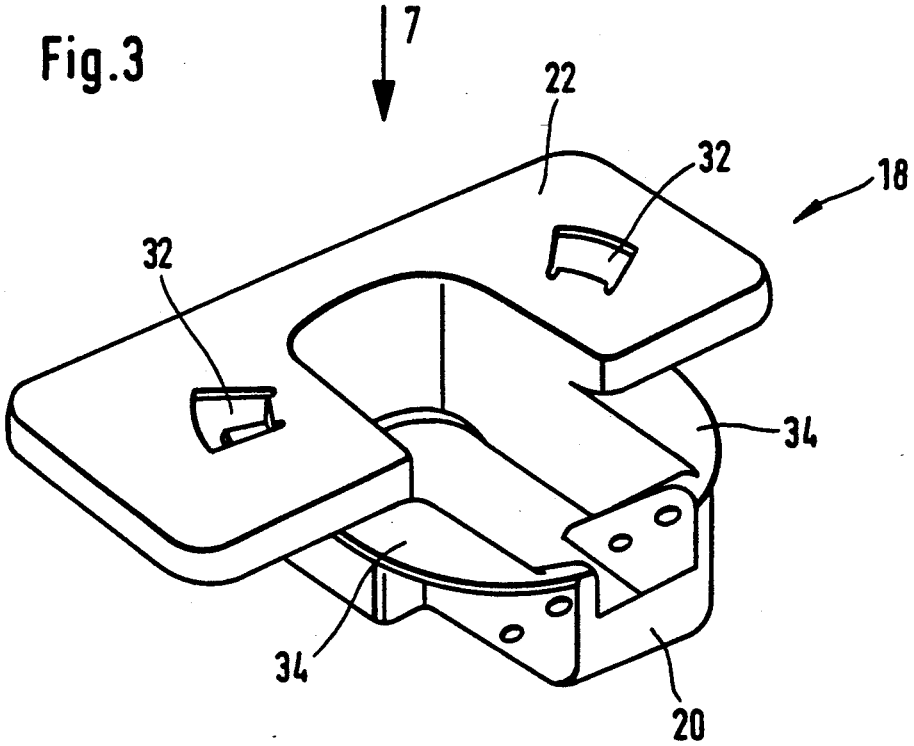
FIG. 3 is a perspective view of the metal cup part of the housing of the hinge shown in FIGS. 1 and 2.

The actual cup part 20, as it can be seen especially in FIGS. 3 and 7, has the form in plan of a bathtub with flattened sides and rounded narrow ends, in which the external radius of the arcuate walls is equal to the radius of the corresponding mortise of circular shape in the door. When the hinge housing is properly installed on a door, the gaps left between the cup part 20 and the wall of the mortise on account of the lateral flattening of the cup part 20 are concealed partly by the mounting flange 22 and partly by circularly defined masking sections 34 attached to the cup part, which are at a level offset from the mounting flange. The openings 32 are formed by stamping out a lug 36 along three sides from the material of the mounting flange 22, and the lug is then, in the manner which can be seen in FIG. 7 and especially in FIG. 8, bent first at right angles into the recess 26 and then, at its free end, back in a radially outward direction substantially parallel to the mounting flange. This outwardly pointing end section of each lug 36 forms a locking projection 36*a*, and the locking projections 36*a* are in turn part of a bayonet locking means whose associated locking slots are formed in the socket plate 28 (FIGS. 4 and 5).

A stronger design of the locking projections 36*a* is obtained if the locking projections are not simply bent from the lugs 36 in the manner described above, but are additionally stabilized on one side by a section of material 36*b* joining each locking projection to the mounting flange 22, as can be seen in FIG. 9. That is to say, the section of lug 36 that is bent at right angles into the recess merges at an angle with the material section 36*b*.

The socket plate 28 is defined arcuately at 38 on the side facing the cup part 20, the radius of the arc being again equal to the radius of the corresponding door mortise. That is, the arcuately defined wall section 38 of the socket plate 28 engages the circularly defined wall section of the cup part 20 underneath the mounting flange.

The position of the lugs 36 cut from the openings 32 is made such that the sections bent at right angles into the recess 26 also lie on the radius of the arcuate wall section, while the locking projections 36*a* bent from these to the position pointing radially outwardly parallel to the mounting flange 22 would collide with the socket plate unless locking grooves 40 were associated with them in the wall section 38 of the socket plate 28, which are composed each of an entry section 40*a* open at the top and in wall section 38, and an adjoining locking section 40*b* running arcuately in a plane parallel to the mounting flange 22 and likewise being open in the wall section 38. The entry sections 40*a* provided at one end of each of the locking sections 40*b* are so dimensioned in their cross section that the locking projections 36*a* can be inserted into them vertically, i.e., parallel to the central axis of the door mortise, until the mounting flange 22 rests on the upper side of the socket plate. By turning the cup part 20 toward the adjoining locking sections 40*b*, the locking projections 36*a* then enter the locking sections 40*b* and the metal cup part is locked to the socket plate and can be removed therefrom only by turning it in the opposite direction.

The socket plate in turn is to be able to be preinstalled on the door independently of the fastening of the cup part 20, and various possibilities of doing this are conceivable. For example, the socket plate can be fastened to the inside of the door by screws (not shown). In the embodiment represented, countersunk bores 42 are provided to accommodate these screws. In FIG. 4, the possibility is also indicated in dash-dotted lines for the formation of integral studs 44 on the bottom of the mounting plate facing the door, which can be driven in by hammering or expanded by the mounting screws.

In FIGS. 4 and 5 it can be seen that the entry sections 40*a* of the locking groove 40 are each provided at the forward end of the locking sections in the clockwise direction, so that, in order to lock the cup part 20 with the associated mounting flange 22 onto the socket plate 28, it must be placed at an angle counterclockwise by the appropriate amount away from the intended mounting position so that the locking projections 36a will be aligned with the entry sections 40a of the locking groove.

To prevent any unintentional turning back of the cup part and of the supporting arm 12 attached to it through the hinge links 14 and 16, a tongue 46 is cut from the material of the socket plate 28 at two laterally adjoining slots 48; the free end of the tongue extends beyond the edge 24 of the mounting flange 22 in the locking position. Material is removed from the bottom of the tongue facing the door, so that the tongue can flex resiliently toward the inside of the door, while on its upper side a groove-like indentation 50 is provided, into which the edge 24 of the mounting flange snaps when in the proper locking position. Any unlocking of the cup part 20 by rotation in the unlocking direction is thus possible only when the portion of the tongue 46 that forms a handle projecting beyond the edge 24 of the mounting flange is depressed so that the edge 24 comes free of the groove-like indentation 50. The projecting part of the tongue 46 that forms the handle is chamfered on its upper side such that, when the cup part is turned relative to the socket plate, the angled edge 24 of the mounting flange 22 approaching the free end of the tongue in the locking position will slide up on the chamfered upper side and, as rotation to the locking position continues, it will increasingly depress it toward the inside of the door against the tongue's bias, until the groove-like indentation is aligned with the edge 24 and the tongue then snaps upward to its locking position.

The upper part of the socket plate 28 that lies within the indentation 26 would prevent the rotation of the cup part relative to the socket plate if it were to fill the indentation completely. Therefore this upper part is configured in the manner seen in FIGS. 4 and 5 such that the rotation-preventing areas, represented in dash-dotted lines in FIG. 4, are cut away, or the injection molding die is shaped so that the areas represented in dash-dotted lines are not even formed. The indentation 26 in the mounting flange 42 is therefore not filled up in these areas by the socket plate, although this would not result in any impairment of the strength of the bayonet lock of the cup part 20 to the socket plate 28.

Figure 10:
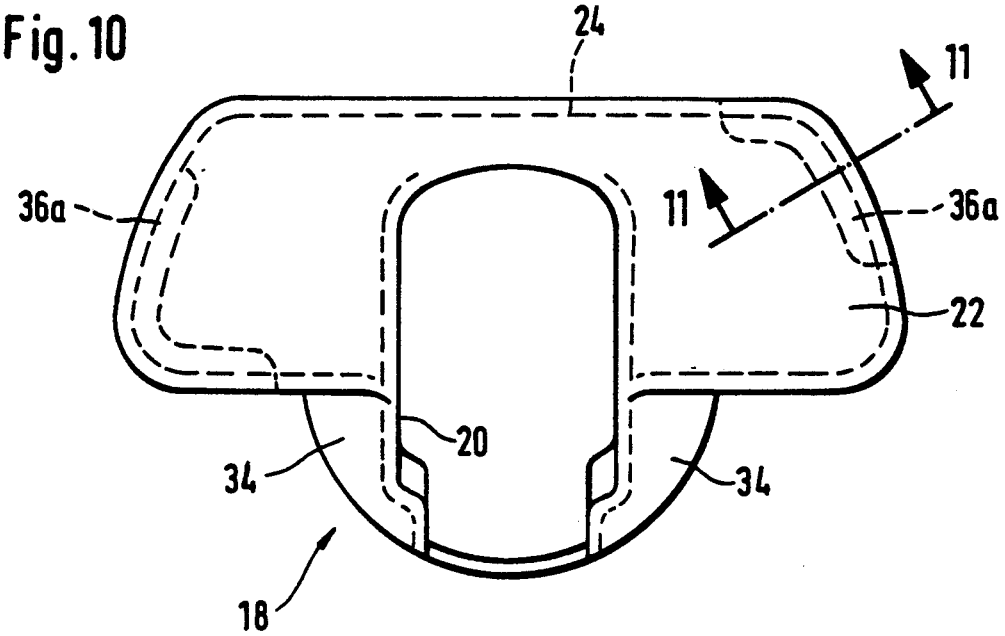
FIG. 10 is a top view of the metal cup portion of a variant embodiment of the hinge housing of the invention.
Figure 11:
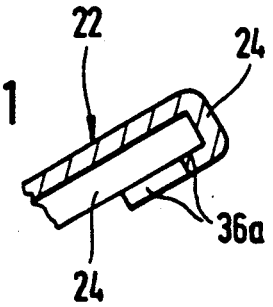
FIG. 11 is a section through part of the cup, seen in the direction of the arrows 11—11 in FIG. 10.
Figure 12:
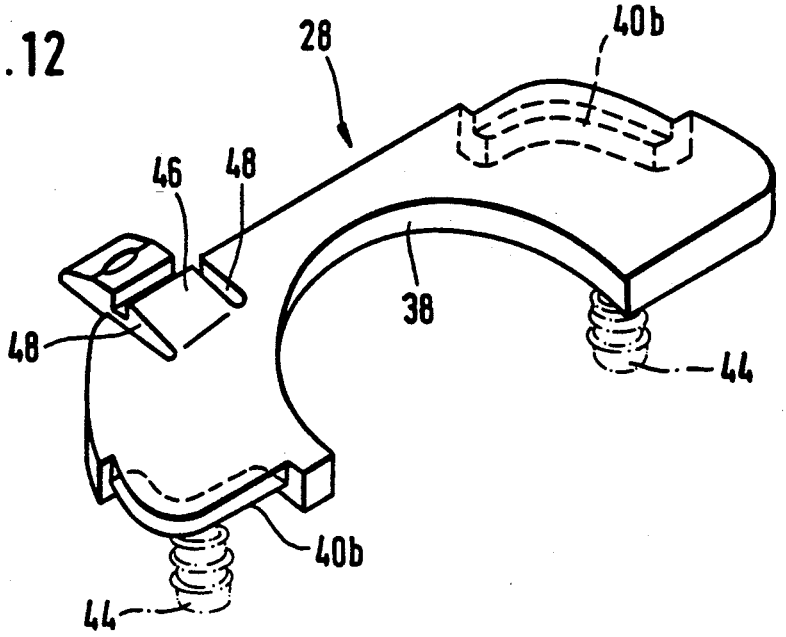
FIG. 12 is a perspective view of the socket plate belonging to the cup portion shown in FIG. 10.

FIGS. 10 to 12 depict an embodiment differing from the one described above in conjunction with FIGS. 1 to 9 only in regard to the configuration and arrangement of the locking projections 36a on the mounting flange and the associated locking grooves 40b in the mounting flange. Therefore it will suffice to describe only these modifications, while otherwise the above description can be consulted, since identical parts of the two embodiments are provided with the same reference numbers.

An important difference from the preceding embodiment is that the locking projections 36a point inwardly, i.e., into the recess 26, from diagonally opposite areas of the free edge of the bent margin of the mounting flange 22. Matching the shape and length of the locking projections 36a, the locking grooves 40b are provided in the associated areas of the socket plate in the outer marginal area of the socket plate 28 when the mounting flange 22 is in the properly installed position. The locking grooves 40b thus open into these outer marginal areas.

The socket plate 28 is in this case substantially flat on the upper side, except for the area of the tongue 46, and the mounting flange 22 is therefore supported by placing the free edge of the bent margin 24 of the mounting flange on the upper side of the socket plate, in the marginal area thereof.

Figure 13:
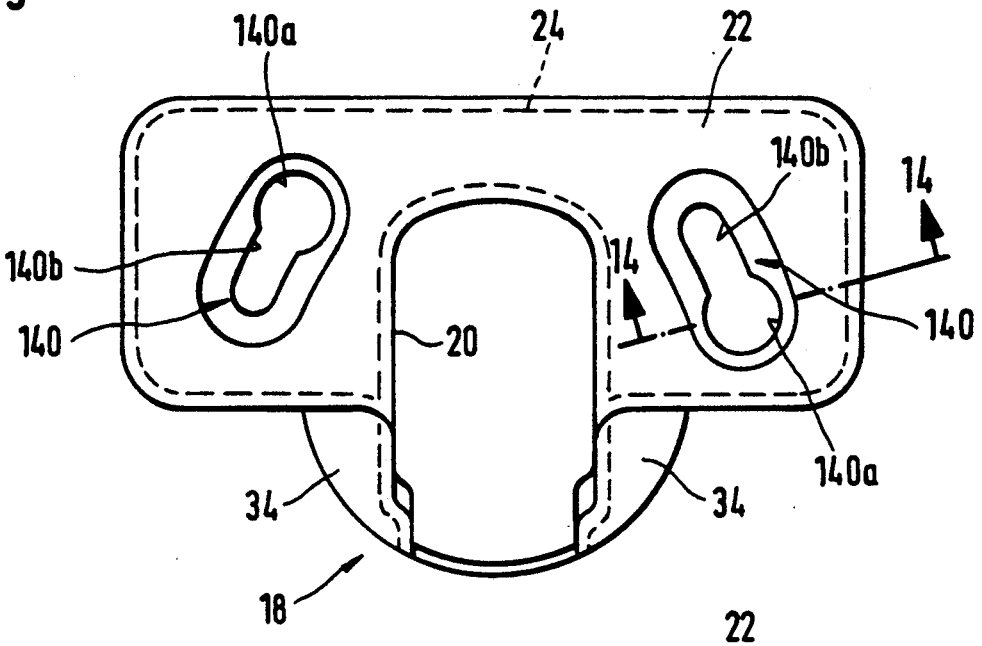
FIG. 13 is a top view of the metal cup portion of another variant embodiment of the hinge housing according to the invention.
Figure 14:
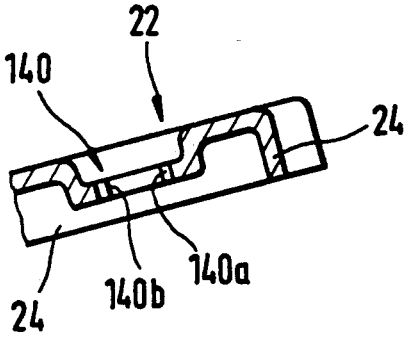
FIG. 14 is a section through part of the mounting flange of the cup portion, seen in the direction of the arrows 14—14 in FIG. 13.
Figure 15:
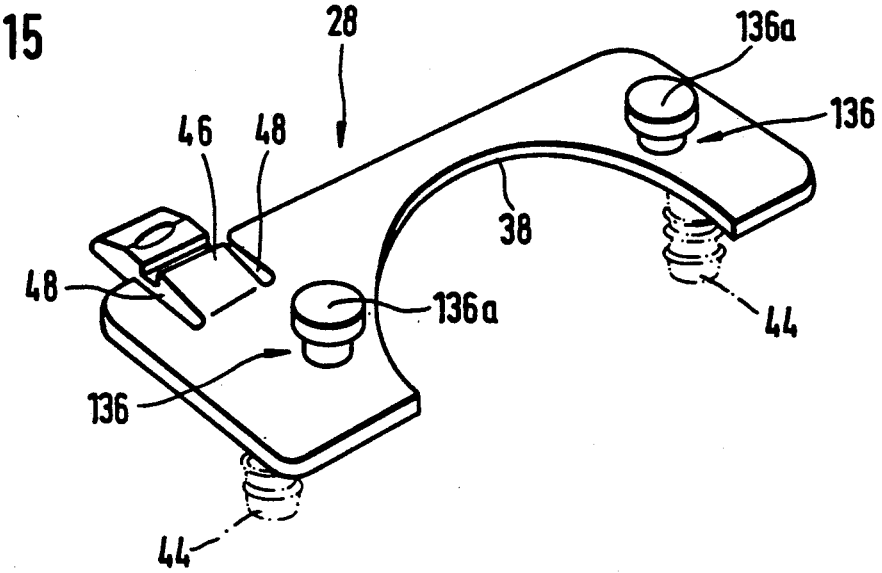
FIG. 15 is a perspective view of the socket plate associated with the cup portion shown in FIG. 13.

In FIGS. 13 to 15 there is shown an additional embodiment of a hinge housing configured in the manner of the invention, wherein—in a cinematic reversal, so to speak, of the embodiment first described—the locking projections 136a are provided on the socket plate, and the locking holes 140 receiving the locking projections are provided in the mounting flange 22. The configuration is therefore made such that two locking holes 140 set apart from one another are created in the mounting flange on opposite sides of the cup 20, each having a slot-like locking section 140b of arcuate shape and, at the end of this locking section, enlarged entry sections 140a, and each locking section as a whole is formed in recessed or sunken areas of the mounting flange. The locking projections 136 then rise from the upper side of the socket plate 26 facing the mounting flange 22, and bear a locking head 136a of enlarged diameter formed on a shank of lesser diameter. The diameter of the locking heads 136a are such that they can pass through the entry sections 140a of the locking holes 140. When the cup part 20 is then rotated clockwise, the shanks of the locking projections 136 then enter into the locking sections 140b of the locking holes 140 and the mounting flange 22 is then secured by the locking sections against being lifted off. Because portions of the locking holes 140 laterally adjoining the locking sections 140b are made to slope slightly (not visible in the drawing) toward the inside surface of the corresponding door, a certain pull can be achieved having the effect of pressing the mounting flange firmly against the socket plate when in the correct locking position. In this case too, the socket plate is again substantially flat on the upper side, i.e., the mounting plate is supported on the socket plate exclusively in the marginal area of the socket plate when in the installed position.

It can be seen that, within the scope of the idea of the invention, modifications and improvements of the examples described above can be carried out, which relate both to the number and to the location of the locking projections forming the bayonet lock mechanism, and of the corresponding locking slots. The location of the mounting holes 42 and of any hammer-in or spreading pins 44 is also variable. It is essential only that the socket plate, which is of a low height overall, can be pre-installed in the area of the mortise on the inside of a door, and that the metal cup part can then afterward be inserted into the mortise and locked to the socket plate. It is also apparent that the hinge housing can be used not only for the four-joint hinge shown, but in the same manner for other cabinet hinges in which the door-related part is a cup which can be sunk in a mortise in the door. That is, the hinge housing 18 can be used in like manner also for corresponding single-joint hinges or wide-angle hinges, in which the socket plate 28 is the same for the different kinds of hinges. Accordingly, doors with pre-installed socket plates 28 can be completed with any of the above-mentioned hinges, or one type of hinge—for example the four-joint hinge of FIGS. 1 and 2—can be replaced with another type—say a wide-angle or crosslink hinge—in order to obtain a wider door-opening angle. Also, it is possible when transporting knocked-down cabinets to remove the cup parts of the corresponding hinges from the doors, so that the doors can be compactly packaged.

An important advantage of the lock produced exclusively between the socket plate 28 and the mounting flange 22 of the cup part 20 is also to be seen in the fact that the depth of the cup part 20 is of no importance, i.e., hinge housings with cup parts of different depth can be mounted on doors with pre-installed socket plates as long as the mortises to be provided in the doors to accommodate the cup parts are bored sufficiently deep. It is also to be noted that, when hinges are used with the hinge housing according to the invention for hanging doors which are provided with different hole patterns for the hammer-in or spreading pins 44 or even screws, only a socket plate adapted accordingly need be used, while the metal cup part and the rest of the hinge can remain unaltered.

On the above-mentioned possibility of changing the position of the locking projections, it is to be pointed out that it is possible—in the case of a hinge housing made from sheet metal—to stamp the tongues for the locking projections from the wall material of the actual cup part, i.e., the part that is to be sunk in the mortise in the door, and then to bend the tongues away from the wall such that they form locking projections projecting radially parallel from the mounting flange at a distance apart. This assumes, of course, that the wall of the cup part, in the area of the locking projections made in this manner, is carried to the direct vicinity of the associated wall of the mortise in the door. Preferably this possibility will serve for the formation of a third locking projection placed in the center between the other two locking projections, underneath the narrow central part of the mounting flange, although, as mentioned, the two locking projections joining the cup part to the socket plate on opposite sides can be produced in this manner if the cup part has a sufficiently large diameter in the locking area.

We claim:

1. Hinge housing in the form of a push-in or hammer-in cup which can be sunk in a mortise in the back of the door of a piece of furniture and which has a cup portion made of metal from whose upper margin a mounting flange projects integrally in the position properly mounted on a door and overlaps areas of the inside surface of the door adjoining the mortise in the door, and whose margin is curved toward the inside surface of the door so that in the mounting flange there is formed a shallow recess opening to the inside surface of the door, and having a fastening member of plastic disposed between the mounting flange and the door, which can be releasably joined to the mounting flange and the door, a locking device for the releasably joining of the fastening member and the mounting flange comprises cooperating locking elements which can be set in locking engagement and out of locking engagement in the manner of a bayonet lock by rotating the cup portion relative to the fastening member over a given angle about an axis of rotation at right angles to the inside surface of the door, wherein said fastening member is designed as a socket plate merely in contact with and secured to the inside surface of the door without engaging into the door-mortise, the locking elements of said locking device being provided at the mounting flange and the socket plate respectively.

2. Hinge housing according to claim 1, with a cup part (20) made by stamping from sheet metal, characterized in that the locking projections (36*a*) are formed on a lug (36) cut free along three edges from the material of the mounting flange (22) and bent, first at right angles to the inside of the door, and its free end sections are bent back substantially parallel to the mounting flange (22) in a direction pointing radially outward, substantially parallel to the mounting flange (22).

3. Hinge housing according to claim 1, whose cup part is made by pressure casting from a metal alloy, characterized in that the locking projections (36*a*) project radially from the free ends of connecting projections integrally cast on the bottom of the mounting flange (22).

4. Hinge housing according to claim 1, characterized in that the locking projections (36*a*) pointing away from the free edge of the bent margin (24) toward the cup part (20) project into the recess (26) in the mounting flange (22).

5. Hinge housing according to any one of claims 2, 3, 4 or 1, characterized in that the socket plate (28) is arcuately defined at least section-wise (at 38) in its area facing the cup part (20), the center of the radius of the arcuate boundary (38) coinciding, in the state in which it is fastened to a corresponding door, with the central axis of the door mortise accommodating the cup part (20).

6. Hinge housing according to claim 5, characterized in that the radius of the arcuate boundary (38) corresponds substantially to the radius of the door mortise.

7. Hinge housing according to claim 1, characterized in that the locking slots (40*b*) open in the arcuate boundary (38) of the socket plate (28).

8. Hinge housing according to claim 4, characterized in that the locking slots (40) open in the outer circumferential boundary surface associated with the margin (24) of the mounting flange (22).

9. Hinge housing according to claim 1, characterized in that the socket plate (28) has a thickness exceeding the clear depth of the recess (26) formed in the mounting flange (22), and that the bottom part of the socket plate (28) facing the door and projecting from the recess (26) is defined corresponding to the outer outline of the mounting flange (22).

10. Hinge housing according to claim 1, characterized in that the upper part of the socket plate (28) lying within the recess (26) fills out the recess (26) in the mounting flange (22) only in a partial area, and when the socket plate (28) and mounting flange (22) are in the intended locking position, cavities not formed by material of the upper part of the socket plate are so defined that the mounting flange (22) can be placed on the socket plate (28) in a position turned at an angle to the socket plate about the central axis of an associated door mortise and can be turned to the proper locking position, the possible turning angle being so selected that the locking projections (36*a*) of the mounting flange (22) can be brought into alignment with the open upper side of the entry section (40*a*) of the locking slots that is associated with each of them.

11. Hinge housing according to claim 1, characterized in that the socket plate (28) has at least one tongue (46) projecting outwardly partially beyond the margin of the mounting flange (22) and movable at right angles to the inside of the door, which tongue has a groove-like recess mating with the margin (24) in the area opposite the free edge of the bent margin (24) in the proper locking position, and that the tongue (46) is resiliently biased to a position lifted away from the inside of the door and receiving the associated marginal area of the mounting flange (22).

12. Hinge housing according to claim 11, characterized in that the tongue (46) is an integral part of the socket plate (28) itself.

13. Hinge housing according to claim 12, characterized in that the tongue (46) is separated from the laterally adjoining areas of the actual socket plate (28) by two through-going lateral boundary slots (50) and is joined integrally with the socket plate (28) only at its inner end on the mounting flange side.

14. Hinge housing according to any one of claims 12 or 13, characterized in that a section of the tongue (46) is chamfered on the upper side, that, upon the rotation of the metal cup part (20) relative to the socket plate (28) from the angularly turned to the locking position, the edge (24) of the mounting flange (22) increasingly deflects the tongue (46) against its bias toward the inside of the door until the groove-like recess (50) is in line with the turned edge (24).

15. Hinge housing according to claim 11, characterized in that a section of the tongue (46) is chamfered on the upper side, that, upon the rotation of the metal cup part (20) relative to the socket plate (28) from the angularly turned to the locking position, the edge (24) of the mounting flange (22) increasingly deflects the tongue (46) against its bias toward the inside of the door until the groove-like recess (50) is in line with the turned edge (24).

16. Hinge housing in the form of a push-in or hammer-in cup which can be sunk in a mortise in the back of the door of a piece of furniture and which has a cup portion made of metal from whose upper margin a mounting flange projects integrally in the position properly mounted on a door and overlaps areas of the inside of the door adjoining the mortise in the door, and whose margin is curved toward the inside of the door so that in the mounting flange there is formed a shallow recess opening to the inside of the door, and having a fastening member of plastic disposed between the mounting flange and the inside of the door, which can be releasably joined to the mounting flange and the door, a locking device for the releasably joining of the fastening member and the mounting flange comprises cooperating locking elements which can be set in locking engagement and out of locking engagement in the manner of a bayonet lock by rotating the cup portion relative to the fastening member over a given angle about an axis of rotation at right angles to the inside of the door, wherein said fastening member is designed as a socket plate merely in contact with and secured to the inside face of the door without engaging into the door-mortise, the locking elements of said locking device being provided at the mounting flange and the socket plate respectively, the mounting flange related locking elements being at least two locking holes spaced apart from another, each with an arcuately running, slot-like locking section and each with an enlarged entry section provided at one end of the locking section, while the socket plate related locking elements are locking projections each associated to one of the locking holes and formed by a shaft projecting from the socket plate and having a locking head of enlarged diameter provided at its free end, whose shaft diameter is slightly smaller than the width of the locking section and whose locking head is larger than the width of the locking section, but smaller than, or in any case equal to, the diameter of the entry section of the locking hole.

17. Hinge housing according to any one of claims 1 or 16, characterized in that the locking holes are each formed in areas of the mounting flange (22) that are formed into the recess (26).

18. Hinge housing in the form of a push-in or hammer-in cup which can be sunk in a mortise in the back of the door of a piece of furniture and which has a cup portion made of metal from whose upper margin a mounting flange projects integrally in the position properly mounted on a door and overlaps areas of the inside surface of the door adjoining the mortise in the door, and whose margin is curved toward the inside surface of the door so that in the mounting flange there is formed a shallow recess opening to the inside surface of the door, and having a fastening member of plastic disposed between the mounting flange and the door, which can be releasably joined to the mounting flange and the door, a locking device for the releasably joining of the fastening member and the mounting flange comprises cooperating locking elements which can be set in locking engagement and out of locking engagement in the manner of a bayonet lock by rotating the cup portion relative to the fastening member over a given angle about an axis of rotation at right angles to the inside surface of the door, wherein said fastening member is designed as a socket plate merely in contact with and secured to the inside surface of the door without engaging into the door-mortise, the locking elements of said locking device being provided at the mounting flange and the socket place respectively, the mounting flange related locking elements being at least two locking projections on the bottom of the mounting flange facing the door, which are spaced apart from one another at a distance from the mounting flange bottom with respect to the longitudinal central axis of the door mortise provided for accommodation of the cup portion, while the socket plate related locking elements are locking slots each for receiving one of the locking projections and undercut substantially in a plane lying parallel to the inside face of the door, which locking slots have each at one end an entry section that is open to the top surface of the mounting flange.

19. Hinge housing according to claim 18 with a cup part made by stamping from sheet metal, the locking projections each are formed from the material of the mounting flange by pressing a small area of the mounting flange in the direction of the door inside into a position substantially parallel to the mounting flange the pressed in areas being cut free along two edges one of which is extending substantially radially outward from and the other one substantially in the locking direction.

* * * * *